US005899242A

United States Patent [19]

Egloff

[11] Patent Number: 5,899,242

[45] Date of Patent: May 4, 1999

[54] THREAD CLAMP CARRIER BODY FOR A BRINGER GRIPPER

[75] Inventor: Anton Egloff, Galgenen, Switzerland

[73] Assignee: Sulzer Rueti AG, Rueti, Switzerland

[21] Appl. No.: 08/851,468

[22] Filed: May 5, 1997

[30] Foreign Application Priority Data

Jun. 14, 1996 [EP] European Pat. Off. ..... 96810398

[51] Int. Cl.[6] ..... D03D 47/23

[52] U.S. Cl. ..... 139/448

[58] Field of Search ..... 139/448, 444, 139/445, 446; 24/130

[56] References Cited

U.S. PATENT DOCUMENTS

| | | | |
|---|---|---|---|
| 4,071,055 | 1/1978 | Haltmeier et al. | 139/448 |
| 4,259,997 | 4/1981 | Tosches | 139/448 |
| 5,129,431 | 7/1992 | Stacher | 139/448 |
| 5,341,852 | 8/1994 | Corain et al. | 139/448 |
| 5,558,133 | 9/1996 | Bortoli et al. | 139/448 |
| 5,819,812 | 10/1998 | Bortoli et al. | 139/448 |

FOREIGN PATENT DOCUMENTS

| | | |
|---|---|---|
| 0 441 099 | 8/1991 | European Pat. Off. . |
| 1 480 561 | 5/1967 | France . |
| 25 44 084 | 3/1977 | Germany . |

*Primary Examiner*—Andy Falik

*Attorney, Agent, or Firm*—Townsend and Townsend and Crew LLP

[57] ABSTRACT

In a bringer gripper for a thread clamp a carrier body is largely open in the upward direction and has a base part and two side walls in order to form upper guides for the warp threads at the reed side and at the cloth side. The side wall at the cloth side comprises a section which extends at an inclination towards the gripper tip. A yarn-protecting deflection of warp threads that are not positioned correctly within the shed is thereby attained.

3 Claims, 2 Drawing Sheets

Fig.2
PRIOR ART
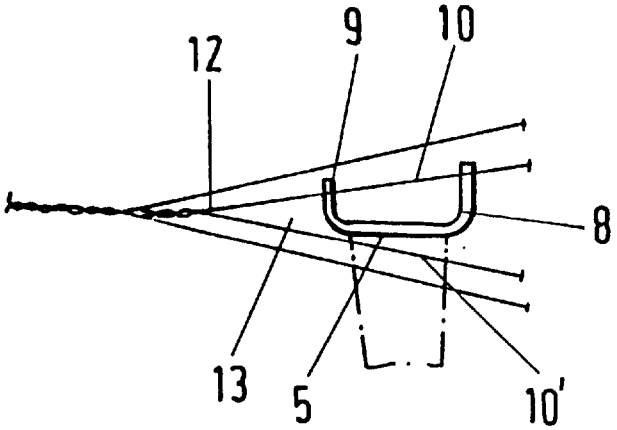
Fig.4
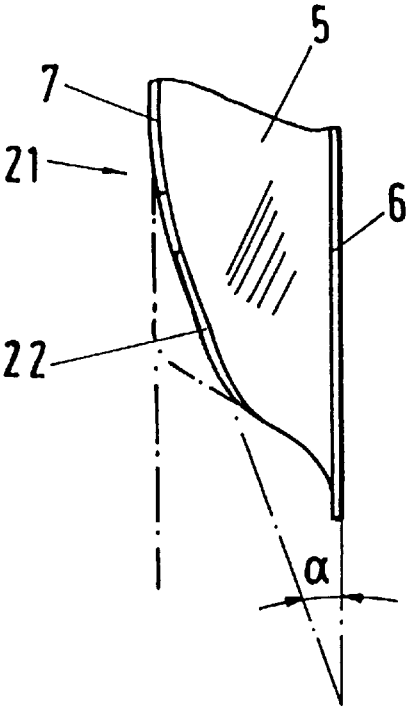
Fig.6
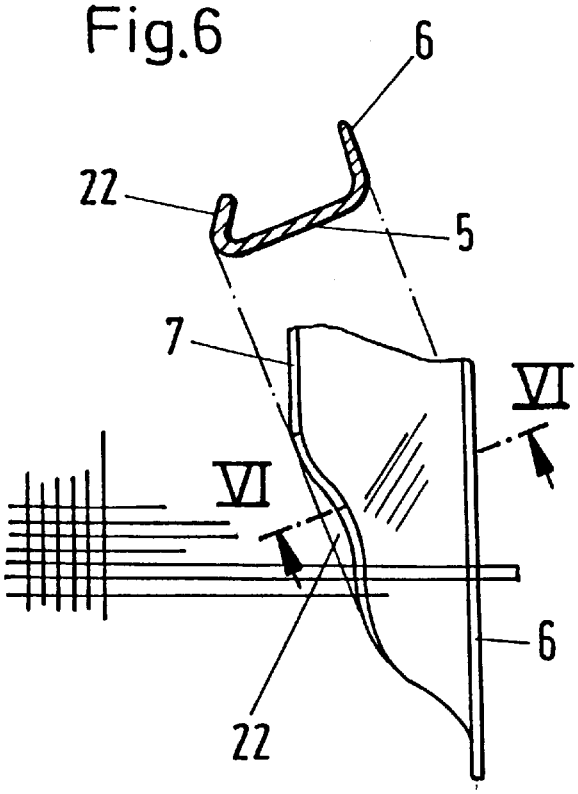
Fig.5

THREAD CLAMP CARRIER BODY FOR A BRINGER GRIPPER

BACKGROUND OF THE INVENTION

1. Field of the Invention

The invention relates to a carrier body for a thread clamp and a bringer gripper with a carrier body.

2. Description of the Prior Art

Reference is made to FIGS. 1 and 2. FIG. 1 shows a section of a known bringer gripper head which contains a carrier body 1 and a thread clamp 2. The carrier body has a base part 5, a side wall 6 on the reed side and a side wall 7 at the cloth side. The wall on the reed side forms a gripper tip 8. The wall at the cloth side comprises a free-standing section 9 which extends parallel to the side wall 6 on the reed side and is intended for the purpose of upwardly deflecting an upper warp thread 9 which is not positioned correctly. For this purpose the section 10 has a flank 11 which begins at the upper side of the base part and rises at an inclination and over which the warp thread slides.

SUMMARY OF THE INVENTION

In this execution of the section 9, problems arise if warp yarns are used which have a tendency to adhere to one another. When adjacent warp threads 10, 10', as seen in FIG. 2, are moved either from or to either the upper or lower shed during a change of shed, the threads can remain stuck to one another so that the apex of the shed 12, as seen in FIG. 2 is displaced in the direction towards the path of the gripper. A smaller shed 13 arises. In this case, the section 9 has the task of deflecting the warp thread 10, which does not correctly extend within the shed, and of opening the shed wider while releasing the snag. Through the parallel orientation of the section 9 an increased frictional resistance arises at the inclined flank 11 so that the warp thread 10 is carried along by the gripper head. The result is that sensitive yarns rip or are damaged, which is a disadvantage.

The object of the invention is to provide a carrier body for a thread clamp in which the disadvantage named is eliminated.

The invention achieves the advantage described in that during weft insertion the separation of the warp threads forming the upper and lower shed and in particular of the warp threads which are stuck together is improved.

BRIEF DESCRIPTION OF THE DRAWINGS

The invention will be explained in the following with reference to the accompanying drawings.

Shown are:

FIG. 2 is a view of the carrier body in the direction of the arrow A in FIG. 1 inside the shed;

FIG. 4 is a view onto a section of the carrier body in the direction of the arrow B in FIG. 3;

FIG. 5 is a view in accordance with FIG. 4 which represents a second embodiment of a carrier body in accordance with the invention, and FIG. 6 is a section along the line VI–VI in FIG. 5.

DETAILED DESCRIPTION OF THE PREFERRED EXEMPLARY EMBODIMENTS

Figures 1, 3:
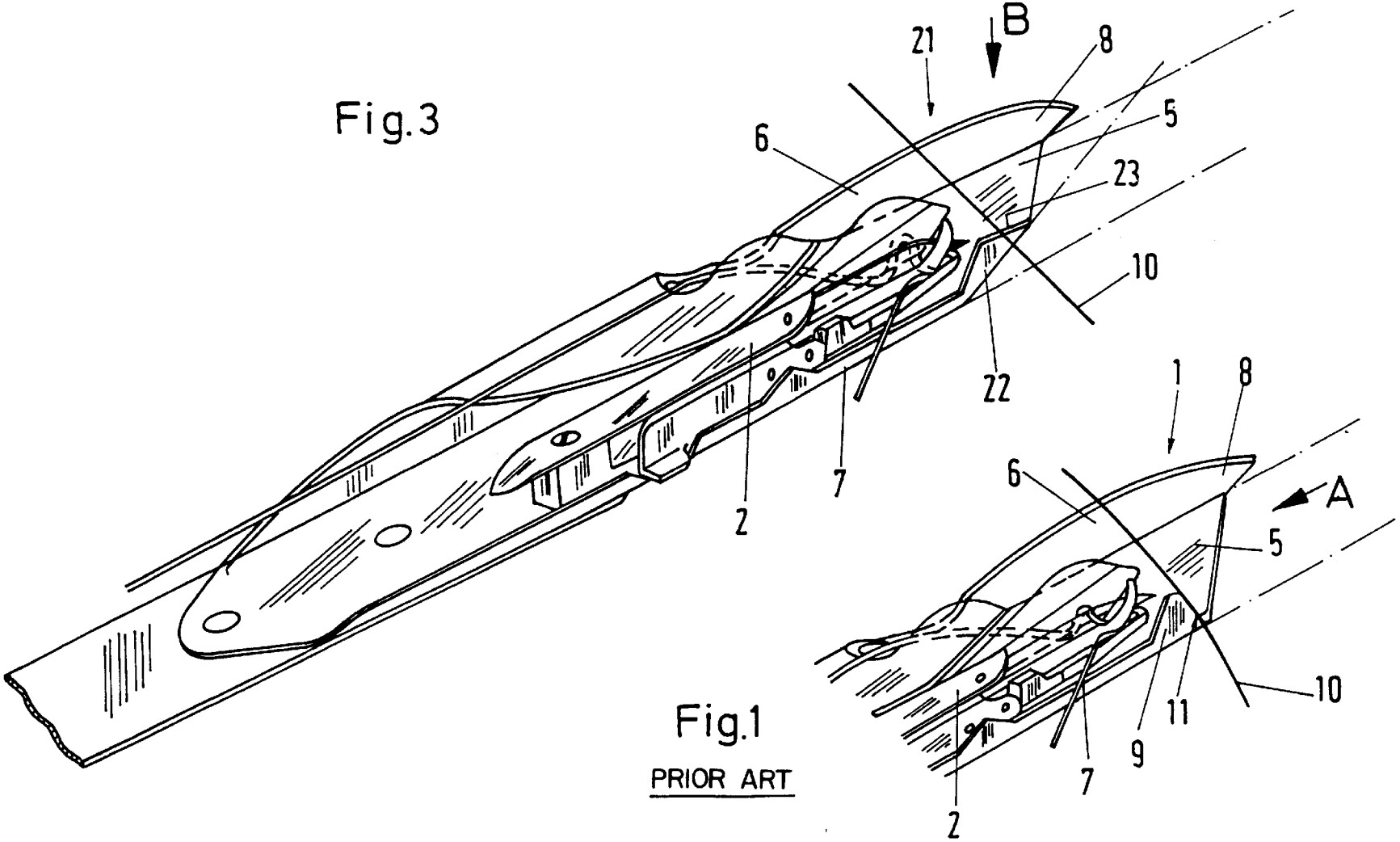
Fig.1 PRIOR ART
FIG. 1 is a spatial view of a section of a known bringer gripper head forming the gripper tip.
FIG. 3 is a section of an embodiment of a bringer gripper head in accordance with the invention forming the gripper tip.

Reference is made to FIGS. 3 and 4. The embodiment of a bringer gripper in accordance with the invention shown in FIG. 3 contains a carrier body 21 and a thread clamp 2 in the manner shown in FIG. 1. The carrier body 21 differs from that of FIG. 1 only in the execution of the free-standing section 22. As can be seen in FIGS. 3 and in particular in FIG. 4, the section 22 is arranged to extend at an acute angle $\alpha$ with respect to the wall on the reed side. Through this arrangement a longer flank 23 can be formed with a lesser inclination so that the deflection of the warp thread 10 is substantially improved and the frictional resistance is substantially improved.

Reference is made to FIGS. 5 and 6. In this embodiment the section 22 is inclined towards the base part 5. An improved and yarn-protecting guidance of the warp threads is thereby attained in comparison with the embodiment of FIGS. 3 and 4.

What is claimed is:

1. A carrier body for a thread clamp including a gripper tip portion, the carrier body comprising:

a base part that defines a horizontal plane;

a reed-side sidewall defining a first vertical plane adjacent the base part; and a cloth-side sidewall defining a second vertical plane substantially parallel to the first vertical plane, the cloth-side sidewall being adjacent the base part and opposite the reed-side sidewall, the cloth-side sidewall having a proximal portion relative to the gripper tip portion that extends at an inclination toward the base part.

2. A carrier body in accordance with claim 1, wherein the portion extends out of the second vertical plane toward the first vertical plane at an acute angle alpha.

3. A carrier body in accordance with claim 1, wherein the portion of the cloth-side sidewall consists of an edge of the cloth-side sidewall.

* * * * *